United States Patent [19]

Takeshima et al.

[11] Patent Number: 4,562,621

[45] Date of Patent: Jan. 7, 1986

[54] SLIDE FASTENER STRINGER

[75] Inventors: Kiyoshi Takeshima, Namerikawa; Ryukichi Murai, Toyama; Yoshinori Nakada, Kurobe, all of Japan

[73] Assignee: Yoshida Kogyo K.K., Tokyo, Japan

[21] Appl. No.: 582,556

[22] Filed: Feb. 22, 1984

[30] Foreign Application Priority Data

Mar. 3, 1983 [JP] Japan ..... 58-30744[U]

[51] Int. Cl.[4] ..... A44B 19/34

[52] U.S. Cl. ..... 24/408; 24/401; 24/413

[58] Field of Search ..... 24/401, 408, 413, 414

[56] References Cited

U.S. PATENT DOCUMENTS

| | | | |
|---|---|---|---|
| 4,171,556 | 10/1979 | Moertel | 24/408 |
| 4,290,175 | 9/1981 | Moertel | 24/408 |
| 4,291,440 | 9/1981 | Yoshida | 24/408 |
| 4,313,244 | 2/1982 | Authier | 24/408 |
| 4,401,138 | 8/1983 | Takahashi et al. | 24/414 |
| 4,429,438 | 2/1984 | Takeshima et al. | 24/401 |
| 4,439,898 | 3/1984 | Takeshima et al. | 24/401 |

FOREIGN PATENT DOCUMENTS

| | | | |
|---|---|---|---|
| 2741579 | 3/1978 | Fed. Rep. of Germany | 24/408 |
| 57-31802 | 2/1982 | Japan | 24/401 |

*Primary Examiner*—William E. Lyddane

*Assistant Examiner*—Peter A. Aschenbrenner

*Attorney, Agent, or Firm*—Hill, Van Santen, Steadman & Simpson

[57] ABSTRACT

A slide fastener stringer comprises an elongate molded coupling element strip woven into a stringer tape along a longitudinal edge thereof. The strip includes a succession of laterally spaced coupling elements each having a pair of first and second legs, and a pair of series of first and second connecting portions extending respectively between alternate pairs of the first legs and between alternate pairs of the second legs in staggered relation with each other. A pair of connector threads is partially embedded in the first and second legs, respectively, of each coupling element and extends parallel to the first and second connecting portions, respectively, on the head side of the coupling elements. Each of the coupling elements has a pair of grooves extending transversely through a pair of first and second legs, respectively, on their outer sides, and disposed remotely from the connecting portions and from the connector threads. A pair of anchor threads is disposed in the grooves in the first legs and the grooves in the second legs, respectively, along the full length of the strips. A weft thread of the tape has a plurality of loops each encircling one of the first and second connecting portions, the connector threads, and the anchor threads between adjacent coupling elements, the weft loops being held out of contact with the connector threads.

5 Claims, 9 Drawing Figures

SLIDE FASTENER STRINGER

BACKGROUND OF THE INVENTION

1. Field of the Invention

The present invention relates to slide fasteners, and more particularly to a slide fastener stringer including a woven stringer tape and an elongate strip of thermoplastic molded coupling elements woven into the stringer tape along a longitudinal edge thereof.

2. Prior Art

Various slide fastener stringers are known in which an elongate strip of thermoplastic molded coupling elements interconnected by molded connecting portions extending integrally with and between adjacent coupling elements, is attached to a woven stringer tape along a longitudinal edge thereof. One example of such known stringers is disclosed in Japanese Patent Laid-open Publication (Kokai) No. 57-31802 published on Feb. 20, 1982. (Corresponds to U.S. Pat No. 4,429,438, issued Feb. 7, 1984.) According to this disclosed slide fastener stringer, an elongate molded coupling element strip includes a plurality of laterally spaced coupling elements each having a pair of upper and lower legs, and a pair of series of first and second connecting portions extending integrally with and between alternate pairs of the upper legs and alternate pairs of the lower legs, respectively, in staggered relation to one another. The coupling element strip is secured by the plurality of loops of a single weft thread to the longitudinal edge of a stringer tape woven of a plurality of warp threads and the weft thread. The loops encircle alternate ones of the first and second connecting portions and a pair of anchor threads (FIG. 10) respectively disposed in a pair of grooves extending transversely of the upper and lower legs, respectively, in substantial alignment with the connecting portions. Since each weft loop is open widely in a direction perpendicular to the general plane of the stringer tape, it urges the anchor threads toward each other between adjacent coupling elements to hold the individual coupling elements firmly in position. However, because each connecting portion extends longitudinally of a respective one of the legs to the middle of the same, and because the anchor threads are urged by the weft loops to lie on and along the molded connecting portions, the stringer has a limited degree of flexibility which hinders smooth movement of a slider on the slide fastener.

SUMMARY OF THE INVENTION

It is therefore an object of the present invention to provide a slide fastener stringer in which a row of spaced molded coupling elements is attached to a stringer tape with adequate firmness, and which has a desired degree of flexibility for smooth movement of a slider on the slide fastener.

According to the present invention, a slide fastener stringer comprises an elongate molded coupling element strip having a succession of laterally spaced coupling elements each including a pair of first and second legs. The strip further has a pair of series of first and second connecting portions extending respectively between alternate pairs of the first legs and between alternate pairs of the second legs in staggered relation to one another. A pair of connector threads is embedded in the first and second legs, respectively, of each coupling element and extends alongside the first and second connecting portions, respectively, on the head side of the respective coupling elements. Each coupling element has a pair of grooves extending transversely through each pair of the first and second legs, respectively, on their outer sides, the grooves being disposed remotely from the connecting portions and the connector threads. A pair of anchor threads is disposed in the grooves in the first legs and the grooves in the second legs, respectively, along the full length of the strip. A weft thread of a woven stringer tape includes a plurality of loops disposed along a longitudinal edge of the tape, each loop encircling one of the first and second connecting portions, the connector threads, and the anchor threads between adjacent coupling elements, thereby securing the coupling elements to the longitudinal tape edge. The connector threads are held out of contact with the weft loops, thus improving the flexibility of the stringer tape.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 2:
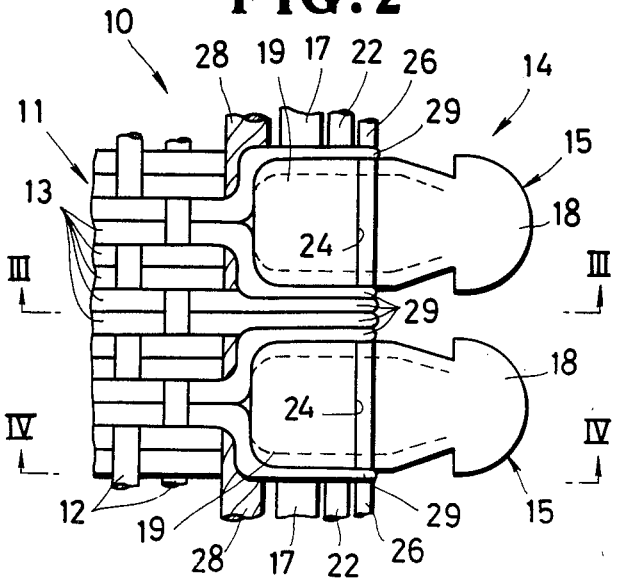
FIG. 2 is a fragmentary plan view of a slide fastener stringer embodying the present invention.

The priniciples of the present invention are particularly useful when embodied in a slide fastener stringer such as shown in FIG. 2, generally indicated by the numeral 10.

The slide fastener stringer 10 comprises a stringer tape 11 woven of a plurality of warp threads 12 and a single weft thread 13, and an elongate coupling element strip 14 of thermoplastic synthetic resin woven into the stringer tape 11 along one longitudinal edge thereof in a known manner.

Figure 1:
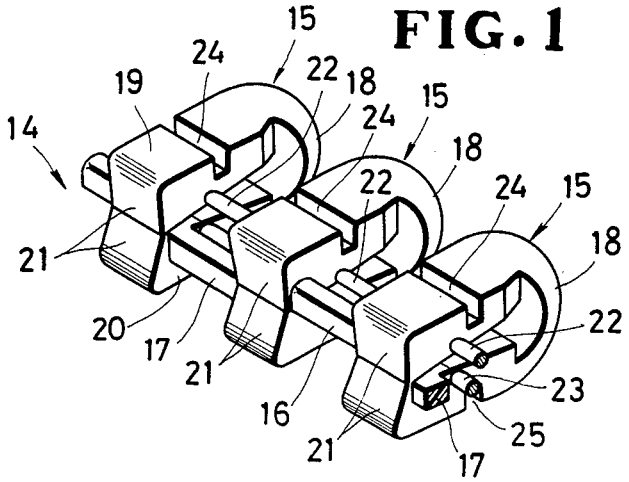
FIG. 1 is a fragmentary perspective view of a molded coupling element strip of the present invention.

As shown in FIG. 1, the elongate coupling element strip 14 includes a succession of laterally spaced coupling elements 15 interconnected by a pair of series of first and second connecting portions 16, 17. Each of the coupling elements 15 has a substantially U-shaped cross section and includes a coupling head 18 and a pair of first and second legs 19, 20 extending from the coupling head 18 in a common direction. The first and second legs 19, 20 are spaced apart in substantially superimposed relation to one another and contact each other at respective heels or the distul ends 21, each leg having a varying width progressively reducing in a direction from its outer side to its inner side.

Figure 3:
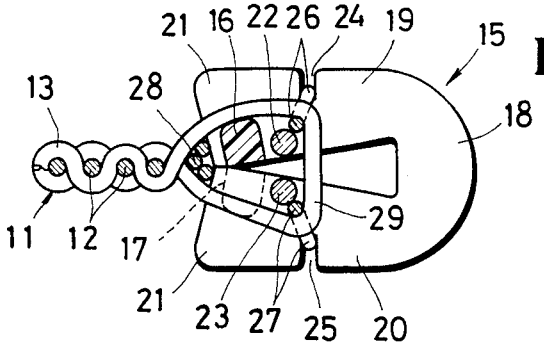
FIG. 3 a cross-sectional view taken along line III—III of FIG. 2.
Figure 4:
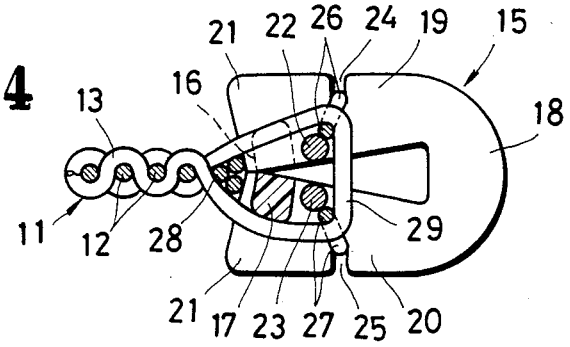
FIG. 4 is a cross-sectional view taken along line IV—IV of FIG. 2.

The first and second connecting portions 16, 17 are disposed adjacent to the heels 21 of the respective legs 19, 20 and extend transversely of the coupling elements 15 in longitudinal alignment with each other as viewed from the general plane of the stringer 10 (FIG. 1). The first connecting portions 16 extend integrally with and between alternate pairs of the first legs 19 and the second connecting portions 17 extend integrally with and between alternate pairs of the second legs 20 in staggered relation to the first connecting portions 16. Thus, each of the first and second connecting portions 16, 17 is fully interrupted only between every second pair of the first and second legs 19, 20. Each of the connecting portions 16, 17 has a thickness smaller than the thickness of the respective legs 19, 20 and has a substantially rectangular cross section, as shown in FIGS. 3 and 4.

The coupling element strip 14 is molded of a single thermoplastic synthetic resin material and is continuously produced on an extrusion molding machine (not shown). The strip 14, prior to being bent into U-shaped cross section ready for attachment to the stringer tape 11, has a zigzag or meandering structure as understood from FIG. 1.

A pair of connector threads 22, 23 extends transversely of the coupling elements 15 along the full length of the coupling element strip 14. The connector threads 22, 23 are normally parallel to and spaced a short distance from the first and second connecting poritons 16, 17 respectively, toward the coupling heads 18 of the coupling elements 15. The connector threads 22, 23 are only partially embedded in the first and second legs 19, 20 simultaneously with the molding of the strip 14 such that they lie at confronting surfaces of the first and second legs 19, 20 of each coupling element 15 as shown in FIGS. 3 and 4.

Each coupling element 15 has a pair of grooves 24, 25 extending transversely through the first and second legs 19, 20, respectively, on their outer sides. The grooves 24, 25 are parallel to and spaced from the connector threads 22, 23 toward the coupling heads 18 of the coupling elements 15. A pair of anchor threads 26, 27 extends through the grooves 24 of the first legs 19 and through the grooves 25 of the second legs 20, respectively, along the full length of the coupling element strip 14. A guide cord 28 extends between the stringer tape 11 and the coupling element strip 14 along the full length of the strip 14. The guide cord 28 is composed of three threads twisted together and is thicker than the warp and weft threads 12, 13 of the stringer tape 11.

As shown in FIGS. 2 to 4, the weft thread 13 of the woven stringer tape 11 has a plurality of loops 29 disposed along the longitudinal edge of the tape 11, each loop 29 encircling the guide cord 28, one of the first and second connecting portions 16, 17, the connector threads 22, 23, and the anchor threads 26, 27 between an adjacent pair of the coupling elements 15, 15, thereby securing the coupling elements 15 to the longitudinal tape edge. More specifically, each of the loops 29 extends arcuately between the guide cord 28 and one of the anchor threads 26, 27 across a corresponding one of the connecting portions 16, 17, then vertically between the anchor threads 26, 27, and then straightly between the other anchor thread 27 and the guide cord 28, thereby defining a substantially triangular space expanding progressively in a direction from the guide cord 28 to the anchor threads 26, 27. The connector threads 22, 23 are held out of direct contact with the loops 29 of the weft thread 28.

Figure 5:
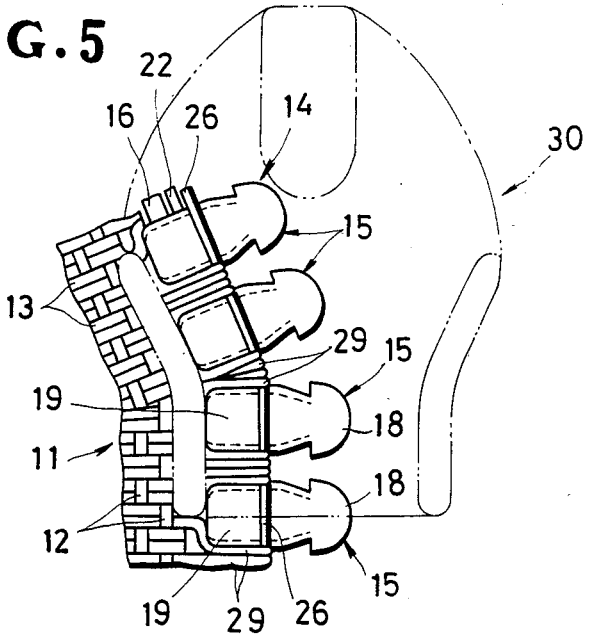
FIG. 5, appearing with FIG. 1, is a schematic plan view of the stringer shown in FIG. 2, the view showing the stringer as being bent in a slider.

This arrangement produces the following advantages. Since each loop 29 of the weft thread 13 is open widely, perpendicularly to the general plane of the stringer tape 11, with its maximum height at the anchor threads 26, 27, urges the anchor threads 26, 27 toward each other between adjacent coupling elements 15 to hold the individual coupling elements 15 firmly in position. With the thick guide cord 28 extending through the loops 29 of the weft thread 13, the coupling element strip 14 is secured to the longitudinal tape edge with an increased degree of firmness. Because every pair of coupling elements 15 is interconnected by one of the first and second connecting portions 16, 17 and the two connector threads 22, 23, all of which are inextensible, proper and uniform spaces between the coupling elements 15 are maintained. With the molded connecting portions 16, 17 having their connection adjacent to the heels 21 of the respective legs 19, 20, and with the flexible connector threads 22, 23 held out of direct contact with the weft thread loops 29, as shown in FIG. 5, the coupling element strip 14 is allowed to bend arcuately away from the coupling element strip of a mating stringer (not shown) in conformity with the Y-shaped guide channel of a slider 30 as two of the stringers 10 are engaged and disengaged by the slider 30 to open and close a slide fastener (not shown), thus enabling smooth threading of the coupling element strips into and out of the slider's guide channel.

Figure 6:
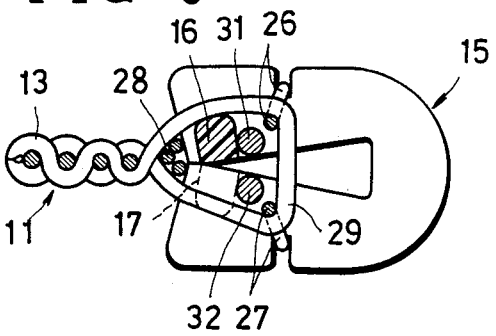
FIGS. 6 to 9 are views similar to FIG. 3, showing various modifications according to the present invention.

FIG. 6 illustrates a modified woven slide fastener stringer having a modified coupling element strip on which a pair of connector threads 31, 32 extends parallel to and in contact with the first and second connecting portions 16, 17, respectively, between adjacent coupling elements 15. The connector threads 31, 32 have a radius of curvature slightly greater than that of the connecting portions 16, 17 during pivoting of the strip as shown in FIG. 5. The connector threads 31, 32 extend without interference with the weft loops 29 and with the anchor threads 26, 27. With this arrangement, the coupling element strip can be bent easier than the strip 14 shown in FIG. 1, in response to movement of the slider (FIG. 5), ensuring smooth threading of the slider on the coupling elements 15.

Figure 7:
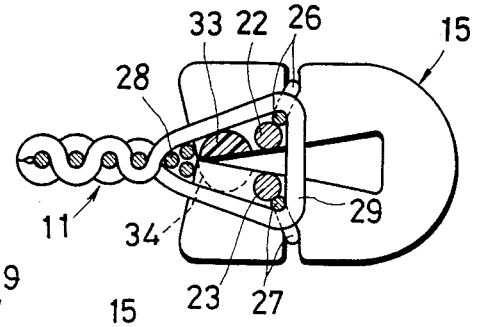

A modified slide fastener stringer shown in FIG. 7 is similar to the stringer 10 of FIG. 3, but is different therefrom in that a molded coupling element strip includes a pair of series of first and second connecting portions 33, 34 (only one pair being illustrated) having a substantially segmental shape in cross section, and having a thickness smaller than the connecting portions shown in FIG. 3 at 16, 17. The coupling element strip thus constructed provides a greater resiliency than the strip 14 of FIG. 2.

Figure 8:
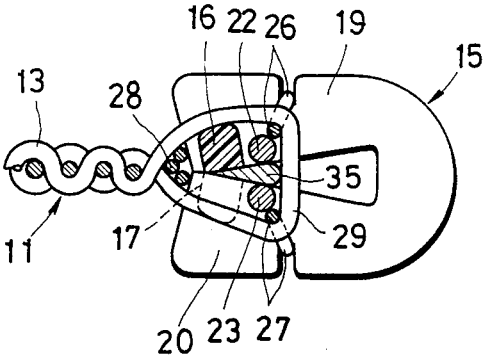
Figure 9:
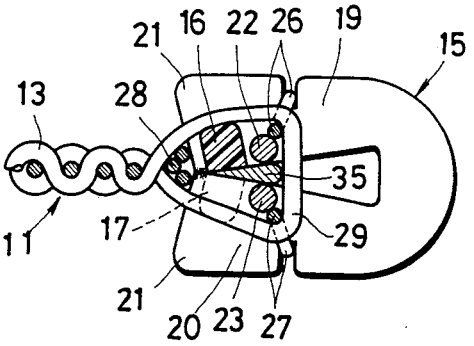

Another modified slide fastener stringer shown in FIG. 8 is substantially the same as the stringer of FIG. 3 with the exception that a stuffer warp 35 extends through the loops 29 of the weft thread 13 and is sandwiched between the first and second legs 19, 20 of the coupling elements 15. Due to the elasticity of the stuffer warp 35, the coupling elements 15 can be attached to the longitudinal tape edge with an increased degree of firmness, thus providing an increased coupling strength when they are meshed with the coupling elements of a mating coupling element strip. The first and second legs 19, 20 may be joined at the respective distal ends or heels 21, 21 by being integrally fused together as shown in FIG. 9, thereby holding the stuffer warp 35 stably in position. With this arrangement, a firm and stable attachment of the coupling elements 15 to the longitudinal tape edge can be achieved.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A slide fastener stringer comprising:

(a) an elongate coupling element strip molded of a single material and having a succession of laterally spaced coupling elements, each of said coupling elements having a coupling head and a pair of first and second legs extending from said coupling head in a common direction and contacting each other at respective distal ends thereof;

(b) said strip further having a pair of series of first and second connecting portions interconnecting said coupling elements at said distal ends of said legs, said first connecting portions extending between alternate pairs of said first legs, said second connecting portions extending between alternate pairs of said second legs in staggered relation to said first connecting portions, each of said connecting portions being fully interrupted only between every second pair of said legs;

(c) a pair of connector threads extending transversely of said coupling elements along the full length of said strip and only partially embedded in said first and second legs, respectively, said connector threads being exposed between adjacent coupling elements, each of said exposed connector threads being disposed adjacent to a respective one of said first and second connecting portions on the coupling head side of each coupling element;

(d) each of said coupling elements having a pair of grooves extending transversely through said first and second legs, respectively, on their respective outer sides, each of said grooves being disposed remotely from a respective one of said first and second connecting portions and from a respective one of said connector threads;

(e) a pair of anchor threads disposed in said first and second grooves, respectively, along the full length of said strip; and (f) a stringer tape woven of a plurality of warp threads and a single weft thread, said weft thread having a plurality of loops disposed along a longitudinal edge of said stringer tape, each of said loops encircling one of said first and second connecting portions, said exposed connector threads, and said anchor threads between an adjacent pair of said coupling elements, thereby securing said coupling elements to said longitudinal edge, said exposed weft loops being held out of contact with said connector threads.

2. A slide fastener stringer according to claim 1, including a guide cord disposed longituindally between said stringer tape and said coupling element strip and extending through said weft loops, said guide cord being thicker than said warp and weft threads.

3. A slide fastener stringer according to claim 2, said guide cord including a plurality of threads twisted together.

4. A slide fastener stringer according to claim 1, each said exposed connector thread being spaced from said respective one of said first and second connecting portions toward said coupling head of each coupling elements.

5. A slide fastener stringer according to claim 1, each said exposed connector thread extending in contact with said respective one of said first and second connecting portions and being held out of contact with a respective one of said anchor threads.

* * * * *